US005105057A

United States Patent [19]

Weinberg

[11] Patent Number: 5,105,057

[45] Date of Patent: Apr. 14, 1992

[54] INSULATED MAGNET WIRE AND METHOD OF FORMING THE SAME

[76] Inventor: Martin J. Weinberg, 167 Fairview Ave., Stamford, Conn. 06902

[21] Appl. No.: 702,512

[22] Filed: May 20, 1991

[51] Int. Cl.[5] ..... H01B 7/02; H01B 13/10

[52] U.S. Cl. ..... 174/121 R; 174/120 SR; 174/121 B; 174/121 SR

[58] Field of Search ..... 174/121 R, 121 B, 121 SR, 174/120 R, 120 C, 120 SR; 156/53, 54

[56] References Cited

U.S. PATENT DOCUMENTS

| | | | |
|---|---|---|---|
| 2,993,949 | 7/1961 | Moebius et al. | 174/124 |
| 3,621,119 | 11/1971 | Sugiyama et al. | 174/113 R X |
| 3,790,694 | 2/1974 | Portinari | 174/23 R |
| 3,842,192 | 10/1974 | Hilker et al. | 174/120 SR |
| 4,360,395 | 11/1982 | Suzuki | 156/54 |

*Primary Examiner*—Morris H. Nimmo
*Attorney, Agent, or Firm*—William W. Jones

[57] ABSTRACT

Magnet wire is insulated with a paper insulation sheet which is longitudinally wrapped onto the wire. The paper sheet is precoated on one side with a layer of resinous adhesive dielectric material such as a thermoplastic polyester. The outside surface of the paper sheet has the resinous coating applied thereto and solidified prior to the time that the paper is wrapped onto the wire. Just prior to applying the paper to the wire, an edge of the resin coating is heated sufficiently to locally remelt the resin. The remelted edge is then overlapped by the opposite edge as the coated paper is wrapped onto the wire, whereby the edges of the insulation sheet are adhered together. The wrapped wire is then passed through one or more heated dies in order to remelt the entire resin coating, which remelted coating is then drawn back over the exterior of the paper layer. The wrapped wire is then passed through a water quench bath. The paper wrap is thus recoated in situ with the resin, thereby forming a continuous and uninterrupted resinous jacket on the paper and wire.

7 Claims, 1 Drawing Sheet

INSULATED MAGNET WIRE AND METHOD OF FORMING THE SAME

This invention relates to an improved insulated magnet or other electrical conductor wire and the method of forming the same. More particularly, this invention relates to a magnet wire which is insulated with a composite paper/resin insulation wherein the resin is precoated onto the paper and then remelted in situ after being wrapped onto the wire and water quenched to form a continuous and uninterrupted resin jacket on the wire.

Electrical conductor wire of the magnet wire type suitable for uses such as starter motor armatures is typically insulated with a paper insulation sheet overcoated with a layer of resinous material such as a thermoplastic polyester. The insulation is typically longitudinally wrapped onto the conductor wire. The method of applying the paper insulation onto the wire involves the step of wrapping the paper over the conductor wire with opposite edges of the paper overlapping each other. A bead of thermoplastic adhesive is continuously laid into the overlapping edge seam in order to adhere the edges of the paper sheet to each other. The wire and overlain paper layers are then fed through a bath of the same thermoplastic resin so that an outer coating of the resin is formed on the paper layer, U.S. Pat. No. 3,842,192 granted Oct. 15, 1974 to Phelps Dodge Industries, Inc. relates to an insulated magnet wire of the type described above and to the method of forming the same.

The magnet wire described above, when properly produced, is readily usable for its intended purpose, and is sufficiently abrasive resistent, pliable and strippable for use in starter motor armatures, or the like. The problem with the above described magnet wire resides in the difficulty in producing it. It is difficult to bond one edge of the paper layer to its opposite edge with continuous and uninterrupted solid bond using the bead laid down on the paper's edge. Likewise, it is difficult to form the edge bond with a resin bead without simultaneously accidently bonding the paper layer to the underlying wire at the inner edge of the seam. Another problem resulting to the manufacture of the aforesaid wire concerns the messiness of the manufacturing line resulting from the beading equipment and the overcoating bath. Thus the prior art linear wrap magnet wire is serviceable, but is also prone to unreasonably excessive scrap production, and creates an undersirable manufacturing environment.

This invention relates to an improved magnet wire of the character described above, and more particularly to a magnet wire incorporating an improved composite insulation material and a method of forming the magnet wire. The insulation material of this invention consists of a strip of paper of the proper requirements which has been precoated on the outside surface with a layer of a thermoplastic resin of appropriate thickness, The precoated paper insulation is wrapped on the wire in the longitudinal fashion. Prior to wrapping the paper/resin composite insulation on the wire, localized heating of one edge of the resin coating is performed to the extent needed to locally melt the resin. The edges of the coated paper insulation are then brought together under pressure to form the sealed edge of the insulation wrap. Once the edges of the insulation have bonded, the wrapped wire is then drawn through one or more heated dies which remelt the resinous layer and constrict and redistribute the melted resin along the length of the wire. The remelted and redistributed resin coated wire is then passed through a water quench bath. The wire is thus clad in situ with a continuous pin hole-free outer resin jacket. The paper/resin insulation does not undesirably bond to the underlying wire, and the forming process is clean and neat. Minimal scrap product is produced, thus process productivity is improved.

It is therefore an object of this invention to provide an improved insulated magnet wire having a composite paper/resin insulation jacket.

It is an additional object of this invention to provide an insulated wire of the character described wherein the insulation consists of a sheet of paper having a precoated thermoplastic resinous layer applied to one surface thereof.

It is a further object of this invention to provide an insulated wire of the character described wherein the resinous layer is sufficiently thick so as to be remeltable and resealable over the exterior of the wire after the paper/resin sheet has been wrapped onto the wire.

It is yet another object of this invention to provide an insulated wire of the character described wherein the paper/resin sheet is wrapped about the wire by melting one edge of the resin coating and then overlapping the opposite edge over the melted edge and bonding the overlapped edges together.

These and other objects and advantages of the invention will become more readily apparent from the following detailed description of a preferred embodiment thereof when taken in conjunction with the accompanying drawings, in which.

Figure 1:
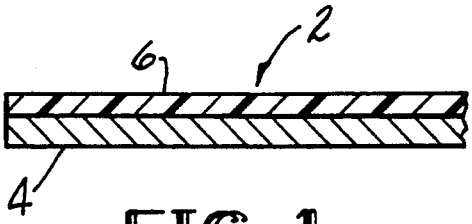
FIG. 1 is a transverse sectional view of the paper/resin insulation tape.of this invention.

Referring now to the drawings the paper/resin insulation tape is denoted generally by the numeral 2 in FIG. 1. The paper component 4 has a coating 6 of a thermoplastic resin. The paper can be a hemp paper, creped kraft paper, rag paper, or other suitable electrical insulation paper. One paper that is preferred for use in certain applications of a 5 mil thick sheet of Copaco 125 brand electrical insulating paper, a product of Cottrell Paper Company of Rock City Fall, N.Y. Then resin is preferably a thermoplastic polyester resin having superior dielectric qualities. The resin coating may be from about 1 mil to about 10 mils in thickness, and is preferably from about 2 mils to about 5 mil. The preferred polyester resin softens at about 370 degrees F., and melts at 425 –475 degrees F.

Figure 2:
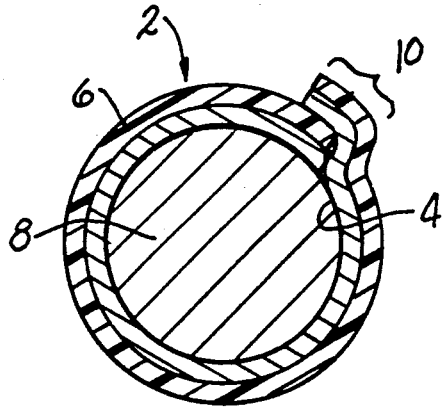
FIG. 2 is a transverse sectional view of the wrapped magnet wire prior to the remelting, recasting of the resinous coating.
Figure 3:
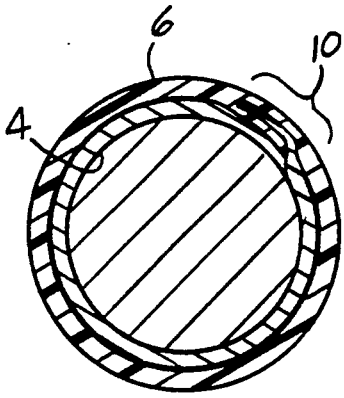
FIG. 3 is a sectional view similar to FIG. 2 but showing the wire after having been drawn through the remelting and recasting die or dies.

FIGS. 2 and 3 show the intermediate and final stages of the insulated wire respectively. FIG. 2 shows the wire immediately after the insulation 2 has been applied thereto. The conductor wire 8 has the composite insulation 2 wrapped thereabout with the paper component 4 abutting the wire 8 and the resin layer 6 facing outward. A well defined seam 10 is established at the opposite edges of the insulation 2 wherein the resin layer 6 is locally melted before the seam is formed. The resin thus provides a bond in the seam 10 so that the insulation 2 is adhered to itself and secured about the wire 8 without bonding to the wire 8. The insulation 2 can thus be easily stripped from the wire 8. It will be noted from FIG. 2 that the entire exterior surface of the insulated wire is defined by the resin coating 6. FIG. 3 shows the structured result of heating the wire of FIG. 2, and concurrently drawing it through a constricted die which recasts the resinous layer 6 over the paper component 4. The wire is then passed through a water quench bath. The resultant product has a continous and uninterrupted outer layer of solid polymer 6 which jackets an inner paper layer 4. The seam 10 shown in FIG. 2 has been substantially obliterated as shown in FIG. 3, and there is no thermoplastic bond between the insulation 2 and the wire 8. This is the result of narrowly confining the extent of the remelted seam, and from forming it by remelting an extant coating of the resin rather than laying a bead onto the edge as the seam is formed.

Figure 4:
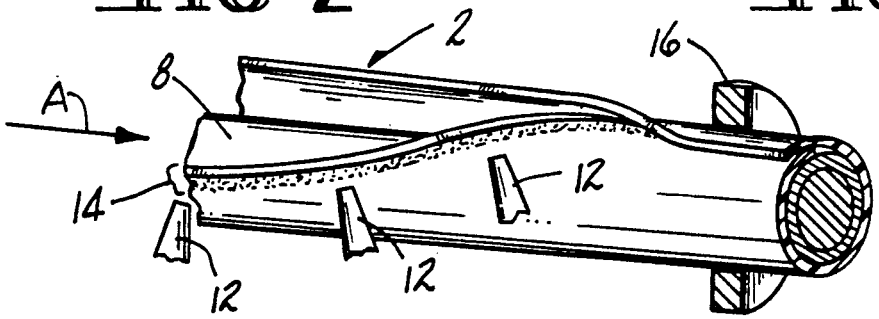
FIG. 4 is a fragmented perspective view of the product as the insulation is being wrapped onto the wire.
Figure 5:
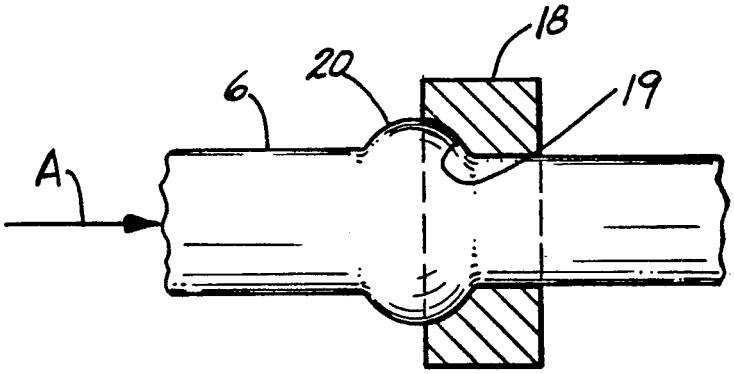
FIG. 5 is fragmented side view partially in section showing the wrapped wire being drawn through one of the heating and recasting dies.

FIGS. 4 and 5 are illustrative of the method by which the magnet wire of this invention is formed. As shown in FIG. 4, the conductor wire 8 is moved in the direction of the arrow A and the composite insulation sheet 2 is brought into confluence with the wire 8 in overwrapping relationship. Heater 12, which is shown schematically may constitute a heated wire, or localized nozzles such as laser nozzles or heated air nozzles. The result of the heaters 12 is to form a narrow and well defined band 14 of melted plastic just prior to passing the product through a compression die 16 which forms the seam 10. As seen from FIG. 5, the wire, after the initial wrapping step, is drawn through one or more heated recasting dies 18 in the direction of the arrow A. The dies 18 are heated to a temperature sufficient to remelt the resinous coating 6 so as to obliterate any seams or irregularities which may be initially present after the insulating sheet 2 is secured about the wire 8. The bore 19 of the die 18 may be tapered as shown in FIG. 5 and sufficiently restricted diametrically so as to contact the resin coating 6 and effectively extrude the outer margin of the resin counter to the direction of the arrow A. Thus a remelted annular bead 20 of the resin will be formed immediately upstream of each die 18. After the remelting and recasting procedure is completed, the wire is passed through a water bath quench. In this manner a very smooth and dimensionally accurate outer surface can be formed on the finished wire. If so desired, the dies 18 can have serially smaller bores so as to remelt and recast the resin layer 6 in progressive steps. For example, at each die 18 at least about 5% of the thickness of the resin layer 6 could be remelted, extruded and recast on the wire for a total reduction of somewhat less than about 15% in the thickness of the resin layer 6. The serial remelting and recasting practically completely eliminated the presence of pin holes in the resin layer 6.

It will be readily appreciated that the magnet wire of this invention will provide an improved hermatic seal of the conductor wire, and will display a smooth, dimensionally accurate, flaw-free resinous outer surface. The insulation is readily strippable from the wire due to the manner in which the original overlapped joint is formed on the wire. The method for forming the magnet wire is clean, efficient and subject to much improved quality control of the resulting product. Although the specific embodiment described above is related to a cigarette of linear wrapped insulation sheet, it is apparent that the invention is equally applicable to a spirally wrapped insulation.

Since many variations of the above described embodiment of the invention will be readily apparent to those skilled in the art, it is not intended to limit the invention otherwise than as required by the appended claims.

What is claimed is:

1. An electrical conductor comprising:

a) a conductor wire;

b) an insulation sheet wrapped onto said wire, said insulation sheet consisting of a paper sheet having one side formed with a layer of thermoplastic resin precoated thereon, said resin layer covering the entire surface of said paper sheet which faces away from said conductor wire, and said insulation sheet having overlapped bonded edges formed by locally melting an edge of said resin layer immediately prior to wrapping said insulation sheet onto said wire; and c) said resin layer being remelted and resolidified in situ on said wire to form a smooth continuous and uninterrupted, dimensionally accurate seamless outer resin surface on the conductor.

2. The conductor of claim 1 wherein said resin layer is coated and solidified on the paper sheet prior to wrapping the latter onto the wire.

3. A method of forming an electrical conductor, said method comprising the steps of:

a) providing a supply of conductor wire;

b) providing a supply of insulation tape, said insulation tape having a paper component and a solidified thermoplastic resin component coated over the entire surface of one side of said paper component;

c) wrapping said insulation tape onto said wire with said paper component facing said wire;

d) locally melting an edge portion of said resin component while retaining the remainder of said resin component, other than said edge portion, solidified;

e) overlapping said melted edge portion of said resin component with a distal edge portion of said paper component to form an overlap joint in said insulation tape which secures said insulation tape to itself but does not substantially bond the insulation tape to the wire; and f) subsequently remelting and re-solidifying the entire exposed surface of said resin component to produce a smooth and continuous outer surface on the conductor.

4. The method of claim 3 wherein said remelting step includes a concurrent step of constricting and drawing the exposed surface of said resin component along the conductor whereby the thickness of said resin component is reduced, and said resin component forms a continuous and uninterrupted jacket on said conductor.

5. The method of claim 4 wherein said remelting and constricting steps are performed by drawing the wrapped wire through one or more heated dies.

6. The method of claim 5 wherein at least one of said dies is operable to form an annular bead of melted resin upstream of said die as said wrapped wire is drawn through said die, said bead moving upstream over said wrapped wire as the later is moved downstream in the direction of drawing through said one die.

7. The method of claim 6 wherein said resin is a thermoplastic polyester having a melting point in the range of about 425 to about 475 degrees F., and wherein the thickness of said resin layer is reduced by about 5% to about 15% by said dies.

* * * * *